US010962233B2

(12) United States Patent
Cimino et al.

(10) Patent No.: US 10,962,233 B2
(45) **Date of Patent: *Mar. 30, 2021**

(54) DOMESTIC HOODS

(71) Applicant: ELICA S.P.A., Fabriano (IT)

(72) Inventors: Marco Cimino, Teramo (IT); Emanuele Spinaci, Fabriano (IT)

(73) Assignee: ELICAS.P.A., Fabriano (IT)

( * ) Notice: Subject to any disclaimer, the term of this patent is extended or adjusted under 35 U.S.C. 154(b) by 387 days.

This patent is subject to a terminal disclaimer.

(21) Appl. No.: 15/302,264

(22) PCT Filed: Mar. 26, 2015

(86) PCT No.: PCT/IB2015/052236
§ 371 (c)(1),
(2) Date: Oct. 6, 2016

(87) PCT Pub. No.: WO2015/155619
PCT Pub. Date: Oct. 15, 2015

(65) Prior Publication Data

US 2017/0023261 A1 Jan. 26, 2017

(30) Foreign Application Priority Data

Apr. 7, 2014 (IT) ..... MI2014A000635

(51) Int. Cl.
*F24C 15/20* (2006.01)
*B08B 15/02* (2006.01)

(52) U.S. Cl.
CPC ..... *F24C 15/2042* (2013.01); *F24C 15/2035* (2013.01); *F24C 15/2064* (2013.01); *B08B 15/02* (2013.01)

(58) Field of Classification Search
CPC .. F24C 15/20; F24C 15/2042; F24C 15/2035; F24C 15/2064; B08B 15/02; F21V 21/096
(Continued)

(56) References Cited

U.S. PATENT DOCUMENTS 2,788,501 A * 4/1957 Buquor ..... H01R 13/6205 439/39
3,068,341 A * 12/1962 Ortiz ..... F21V 21/04 219/220
(Continued)

FOREIGN PATENT DOCUMENTS

DE 10 2009 002 503 A1 10/2010
EP 1467416 A2 10/2004
(Continued)

OTHER PUBLICATIONS

International Search Report dated Jun. 15, 2015, in related PCT Application No. PCT/IB2015/052237, 4 pages.
(Continued)

*Primary Examiner* — Edelmira Bosques
*Assistant Examiner* — Frances F. Hamilton
(74) *Attorney, Agent, or Firm* — MH2 Technology Law Group LLP

(57) ABSTRACT

A domestic hood may include: a support frame with a power input; a motor fan unit located within the support frame; the support frame extends between a lower end portion and an upper end portion, and at the lower end portion the hood has a suction port in fluid communication with the motor fan unit; a filter means arranged between the suction port and the motor fan unit and configured to filter gases extracted by the motor fan unit through the suction port; a lighting means including an enclosure that defines a seat containing a plate having a plurality of light-emitting diodes; a fixing means
(Continued)

for removably fixing the lighting means to the support frame; and an electric connection means for electrically connecting the lighting means to the power input.

20 Claims, 5 Drawing Sheets

(58) Field of Classification Search
USPC .... 454/49, 293, 294, 67, 349, 354; 362/365; 439/39
See application file for complete search history.

(56) References Cited

U.S. PATENT DOCUMENTS 3,706,882 A * 12/1972 Eby ..... B60Q 1/2615 362/398
4,681,024 A * 7/1987 Ivey ..... F24H 3/0411 219/220
4,711,161 A * 12/1987 Swin, Sr. ..... F24F 7/007 454/230
4,730,551 A * 3/1988 Peludat ..... F24F 3/1603 454/233
4,776,263 A * 10/1988 Lokander ..... F24F 3/1603 454/293
5,139,009 A * 8/1992 Walsh ..... F24C 15/2021 126/299 D
5,422,795 A * 6/1995 Liu ..... F24F 13/078 362/96
5,443,625 A * 8/1995 Schaffhausen ..... B01D 46/0006 95/113
5,664,872 A * 9/1997 Spearman ..... F21V 33/0096 362/96
5,865,674 A * 2/1999 Starr ..... B01D 46/0005 454/187
5,934,362 A * 8/1999 Barker, II ..... F24F 7/06 165/237
5,938,527 A * 8/1999 Oshima ..... F24F 1/01 454/303
6,030,287 A * 2/2000 Core ..... F04D 25/088 454/292
6,037,876 A * 3/2000 Crouch ..... G09F 9/33 340/815.53
6,095,660 A * 8/2000 Moriyama ..... F21S 8/026 362/147
6,222,459 B1 * 4/2001 Ting ..... G09G 3/02 340/557
6,274,375 B1 * 8/2001 McMinn, Jr. ..... B05B 3/06 210/167.3
6,380,683 B1 * 4/2002 Kahn ..... H01J 5/50 315/56
6,454,834 B1 * 9/2002 Livingstone ..... B01D 53/04 55/385.3
6,471,738 B1 * 10/2002 Thompson ..... B01D 46/24 454/294
6,903,380 B2 6/2005 Barnett et al.
7,138,667 B2 11/2006 Barnett et al.
7,399,104 B2 * 7/2008 Rappaport ..... F21S 8/02 362/147
7,473,074 B2 * 1/2009 Herbst ..... F04D 29/023 415/116
8,425,082 B2 * 4/2013 Wang ..... F21S 8/04 362/249.02
8,770,771 B2 * 7/2014 Preta ..... H05B 47/19 362/20
8,770,774 B2 * 7/2014 Ye ..... F21V 33/0096 362/235
9,194,603 B2 * 11/2015 Yuan ..... F04D 25/14
9,416,989 B1 * 8/2016 Tom ..... F24F 13/078
9,553,451 B2 * 1/2017 Zacharchuk ..... H04L 12/2816
9,746,197 B2 * 8/2017 Katsumi ..... F24F 11/0001
9,816,717 B1 * 11/2017 Lawrence ..... F24F 7/065
2002/0155805 A1 * 10/2002 Paschke ..... F24F 13/0218 454/293
2004/0201025 A1 10/2004 Barnett et al.
2005/0117341 A1 * 6/2005 Craw ..... F21V 29/673 362/253
2005/0194607 A1 9/2005 Barnett et al.
2005/0260104 A1 * 11/2005 Culbert ..... B60H 3/00 422/121
2006/0160485 A1 * 7/2006 Brake ..... A47J 37/0786 454/293
2006/0223435 A1 * 10/2006 Herbst ..... F24F 7/007 454/260
2006/0278216 A1 * 12/2006 Gagas ..... F24C 15/2028 126/299 D
2008/0265789 A1 * 10/2008 Bertram ..... F21K 9/23 315/185 R
2009/0061752 A1 * 3/2009 Burdett ..... F24C 15/2021 454/61
2009/0118848 A1 * 5/2009 Santinato ..... D06F 34/28 700/90
2009/0134812 A1 * 5/2009 Zhang ..... F04D 25/0613 315/291
2009/0141506 A1 * 6/2009 Lan ..... F21S 8/02 362/351
2009/0211564 A1 * 8/2009 Pan ..... F24C 15/2028 126/299 D
2009/0316413 A1 * 12/2009 Henry ..... H01J 61/52 362/294
2010/0009621 A1 * 1/2010 Hsieh ..... F24F 7/007 454/293
2010/0024106 A1 * 2/2010 Katsumi ..... F24D 5/12 4/213
2010/0068899 A1 * 3/2010 Shvili ..... F21V 21/096 439/39
2010/0112929 A1 * 5/2010 Iantorno ..... F24F 7/065 454/275
2010/0136897 A1 * 6/2010 Lee ..... F24F 13/078 454/293
2010/0328881 A1 * 12/2010 Huang ..... F04D 17/04 361/688
2012/0075857 A1 * 3/2012 Verbrugh ..... F21V 29/73 362/249.01
2012/0194069 A1 8/2012 Wang
2012/0208378 A1 * 8/2012 Rudisill ..... H01R 12/91 439/39
2012/0242213 A1 * 9/2012 Shim ..... H01K 1/44 313/46
2012/0319595 A1 * 12/2012 Antonopoulos ... H05B 33/0803 315/152
2012/0329292 A1 * 12/2012 Fish ..... A61B 5/002 439/39
2013/0043781 A1 * 2/2013 Wang ..... F21V 21/096 313/46
2013/0078902 A1 * 3/2013 Chung ..... F24F 3/056 454/293
2013/0266443 A1 * 10/2013 Yang ..... F21V 33/0096 416/5
2014/0076367 A1 * 3/2014 Hung ..... F24C 15/2021 134/105
2014/0083412 A1 * 3/2014 Chtchetinin ..... A47B 77/08 126/299 D
2014/0273803 A1 * 9/2014 Fontanesi ..... F21V 33/0088 454/293
2014/0326145 A1 * 11/2014 McEvoy ..... A47J 37/0676 99/331
2014/0331988 A1 * 11/2014 Milks ..... F24C 15/2064 126/299 D
2015/0056911 A1 * 2/2015 Brockman ..... F24F 7/08 454/256
2015/0105013 A1 * 4/2015 Jeong ..... F24F 1/0007 454/293

(56) References Cited

U.S. PATENT DOCUMENTS

| | | | | |
|---|---|---|---|---|
| 2015/0168004 | A1* | 6/2015 | Emmons | F24F 13/1426 236/49.5 |
| 2017/0023262 | A1* | 1/2017 | Cimino | F24C 15/2064 |

FOREIGN PATENT DOCUMENTS

| | | | | |
|---|---|---|---|---|
| EP | 1729068 | A1 | 12/2006 | |
| EP | 2278229 | A2 * | 1/2011 | F24C 15/2064 |
| EP | 2481970 | A2 | 8/2012 | |
| EP | 2 565 534 | A1 | 3/2013 | |
| GB | 2116693 | B * | 7/1985 | F24F 13/078 |
| GB | 2 426 791 | A | 12/2006 | |
| GB | 2426791 | A * | 12/2006 | F24C 15/2021 |
| WO | 2006/077498 | A1 | 7/2006 | |

OTHER PUBLICATIONS

Written Opinion dated Jun. 15, 2015, in related PCT Application No. PCT/IB2015/052237, 7 pages.
International Preliminary Report on Patentability dated Oct. 12, 2016, in related PCT Application No. PCT/IB2015/052237, 8 pages.
International Search Report dated Jun. 15, 2015, in corresponding PCT Application No. PCT/IB2015/052236, 4 pages.
Written Opinion dated Jun. 15, 2015, in corresponding PCT Application No. PCT/IB2015/052236, 7 pages.
International Preliminary Report on Patentability dated Oct. 12, 2016, in corresponding PCT Application No. PCT/IB2015/052236, 8 pages.
U.S. Office Action issued in related U.S. Appl. No. 15/302,261, dated Mar. 22, 2018, 14 pages.

* cited by examiner

DOMESTIC HOODS

CROSS-REFERENCE TO RELATED APPLICATION(S)

This application is a national stage entry from International Application No. PCT/IB2015/052236, filed on Mar. 26, 2015, in the Receiving Office ("RO/IB") of the International Bureau of the World Intellectual Property Organization ("WIPO"), and published as International Publication No. WO 2015/155619 A1 on Oct. 15, 2015; International Application No. PCT/IB2015/052236 claims priority from Italian Patent Application No. MI2014A000635, filed on Apr. 7, 2014, in the Italian Patent and Trademark Office ("IPTO"), the entire contents of all of which are incorporated herein by reference.

FIELD OF THE INVENTION

The present disclosure relates to a hood for domestic use as defined in the preamble of claim 1.

DISCUSSION OF THE RELATED ART

Domestic hoods are known, which may be either filter or extractor hoods, and have lighting members required for lighting the food preparation/cooking area.

For this purpose, the lighting members have a frame that may be possibly equipped with a shield having one or more lighting devices therebehind, such as incandescent, neon or LED lamps.

These lighting members are powered by appropriate electric connection means, which are designed to electrically connect the lighting devices to the input section of a power circuit, which is held within the hood frame.

Particularly, these lighting devices are in such arrangement that the light beam emitted thereby can illuminate the cooktop area.

Due to their position, these lighting devices are impinged upon by the gas flow extracted by the motor fan unit located within the hood frame and the gases are filtered by a filter unit located downstream from said lighting means.

Due to their nature, gases tend to deposit a layer of grease on the screen, if any, thereby reducing the lighting capacity.

Thus, the user is required to clean the lighting members and the filter unit.

For this purpose, in such domestic hoods both the lighting means and the filter unit are designed to be removable from the hood frame.

PRIOR ART PROBLEM

The removal of the filter unit requires the lighting means to be removed first. This is not always easy and safe for the user because the removal of the lighting means always requires the user to directly act, by his/her hands or using special tools, on the electric connection means, even though they have a low voltage, e.g. 24 Volt.

EP 1729068 discloses a wall-mounted combination extractor fan and light unit. Particularly, the user can only access the motor within its enclosure by first removing the lamp shields, then unscrewing the lamp from its support and removing the support from the enclosure, as the shield, the lamp and the support are individually movable elements. Therefore, EP 1729068 does not disclose a one-step removal of the assembly composed of the shield, the lamp and the support with simultaneous electric disconnection, with the user not being required to perform additional steps.

SUMMARY OF THE INVENTION

The above described prior art clearly shows that a need is strongly felt by hood manufacturers for simple and quicker removal of the lighting means by the user, without the need of electrically disconnecting such lighting means from the power source, by hand or using tools.

Advantages of the Invention

According to the present invention, this object is fulfilled by a hood as defined in claim 1.

With the present invention, the lighting means can be removed from the hood frame by exerting such a pull force as to release the electric connection with the input section of the power circuit. Thus, the lighting means can be directly and electrically insulated upon removal thereof.

Furthermore, with the present invention, the user may remove the lighting means without having to act upon the electric connections.

BRIEF DESCRIPTION OF THE DRAWINGS

The characteristics and advantages of the present disclosure will appear from the following detailed description of a possible practical embodiment, illustrated as a non-limiting example in the set of drawings, in which.

DETAILED DESCRIPTION

Figure 1:
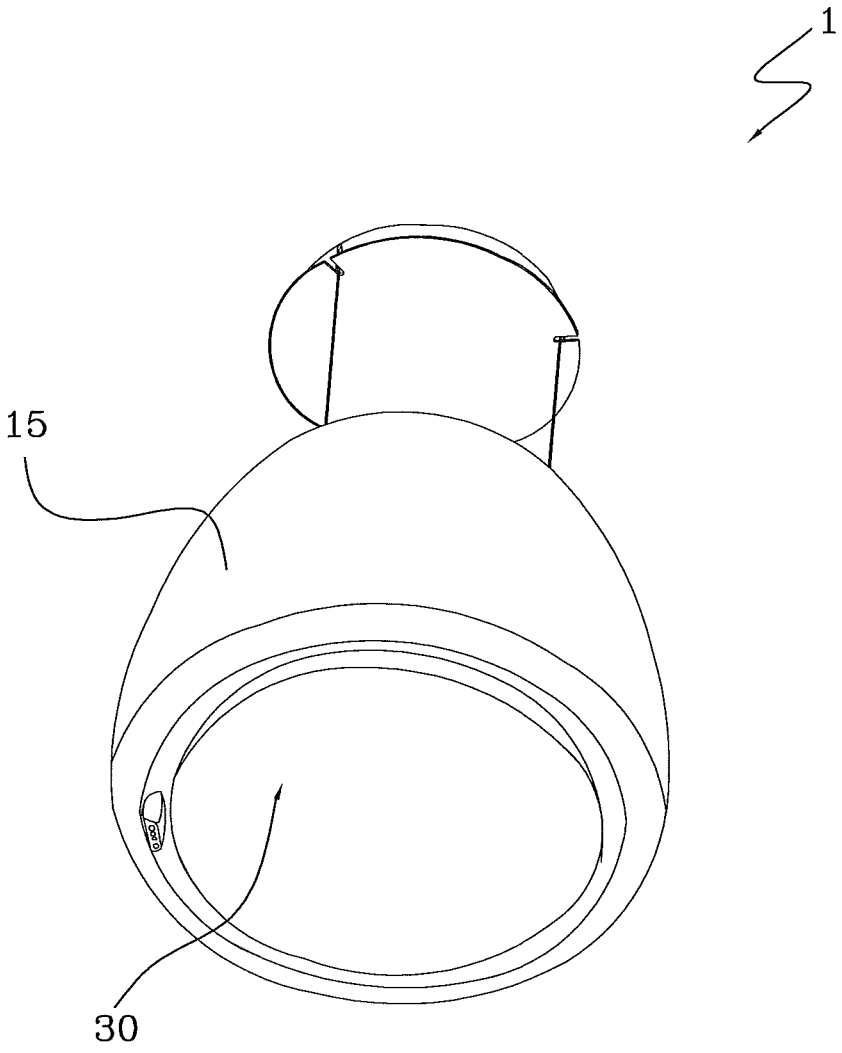
FIG. 1 shows a perspective view of a domestic of the present invention.

Referring to the accompanying figures, numeral 1 designates a hood for domestic use.

The hood 1 extends along a main longitudinal direction X-X and comprises a support frame 10, a motor fan unit 20 located within the frame 10 and supported thereby, as well as lighting means 30.

The support frame 10 extends between a lower end portion 2 and an upper end portion 3.

At the lower end portion 2, the hood 1 has a suction port 4 in fluid communication with the motor fan unit 20.

Filter means 50 are arranged between the suction port 4 and the motor fan unit 20, and are configured to filter the gases extracted by the motor fan unit 20 through the suction port 4.

The hood 1 also comprises a protective enclosure 15 which is disposed outside the support frame 10 to enclose the support frame 10, the motor fan unit 20, and the filter means 50.

At the upper end portion 3, the hood 1 has an exhaust port 5 in fluid communication with the motor fan unit 20.

The frame 10 has a power input 11 through which the hood 1 may be connected to the mains, to supply power to the motor fan unit 20 and the lighting means 30.

In the example of the annexed figures, the power input 11 is located at the upper end portion 3.

The input 11 is connected via respective power lines to the power input (not shown) of the motor fan unit 20 and, via means to be later described in detail, to the lighting means 30.

The lighting means 30 are removably fixed to the support frame 10 and are movable relative to the support frame 10, preferably in the longitudinal direction X-X. For this purpose, the hood 1 comprises fixing means 40 for removably fixing the lighting means 30 to the support frame 10.

The hood 1 further comprises electric connection means 60 for electrically connecting the lighting means 30 to the power input 11.

The lighting means 30 are movable relative to the support frame 10 between a first position (see FIG. 4) in which the electric connection means 60 electrically connect the lighting means 30 to the power input 11, and a second position (see FIG. 5) in which the lighting means 30 are electrically disconnected from the power input 11.

Particularly, the electric connection means 60 are configured to electrically disconnect the lighting means 30 from the power input 11 directly, once the lighting means 30 have moved from the first position to the second position (i.e., without any additional step).

This will afford electric insulation of the lighting means 30 as soon as the lighting means 30 are removed for access to the interior of the support frame 10, e.g. for replacing the filter means. Such electric insulation of the lighting means 30 allows the user to access the filter means 50 without risking any contact with live elements.

According to one embodiment, the filter means 50 are housed in a filter holder 51 which is removably fixed to the support frame 10. Advantageously, the filter holder 51 is removably fixed to the support frame 10 by magnetic coupling. For example, the support frame 10 may be equipped with one or more magnetic elements 52 which hold a metal element 53 embedded in the filter holder 51 or stably fixed thereto.

According to one embodiment, the electric connection means 60 include first contact means 61 arranged on the frame 10 and rigidly joined thereto and second contact means 62 arranged on the lighting means 30 and rigidly joined thereto. Therefore, as said second contact means 62 move from the first position to the second position, they move with said lighting means 30.

In the first position, the first contact means 61 contact the second contact means 62 to electrically connect the lighting means 30 to the power input 11, whereas in the second position the second contact means 62 are electrically disconnected from the first contact means 61 to electrically insulate the lighting means 30.

The first contact means 61 are connected via a power line (not shown) to the power input 11.

In this example, the power line is placed in a cable guide 13 which is rigidly joined to the support frame 10.

In one embodiment, the first contact means 61 comprise at least one male terminal, in this example a single male terminal which preferably extends in the longitudinal direction X-X. This will facilitate the movement of the lighting means 30 in this longitudinal direction X-X from the first position to the second position and vice versa.

Figure 4:
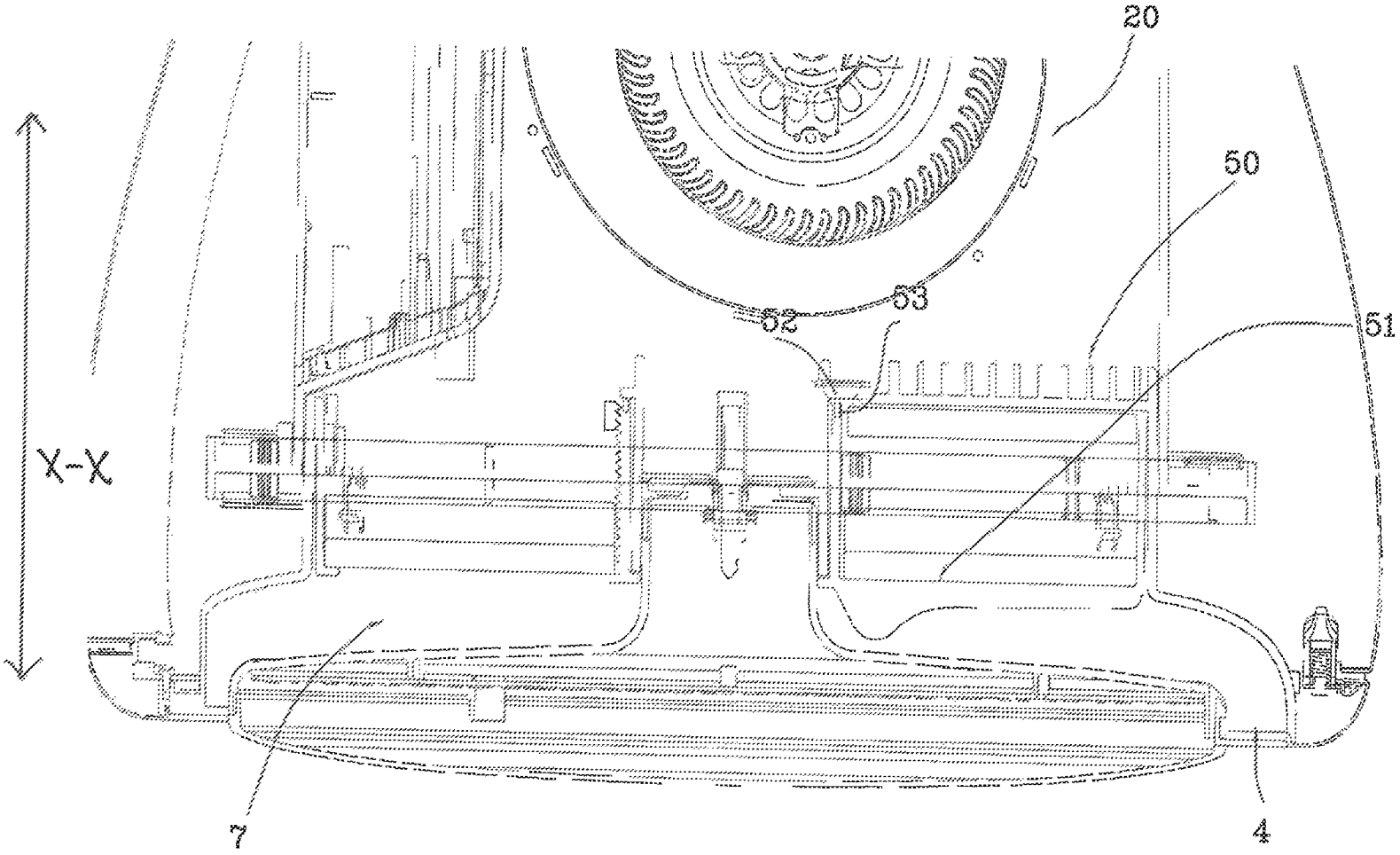
FIG. 4 shows a sectional view of the lighting means associated with the hood frame of the present invention.
Figure 5:
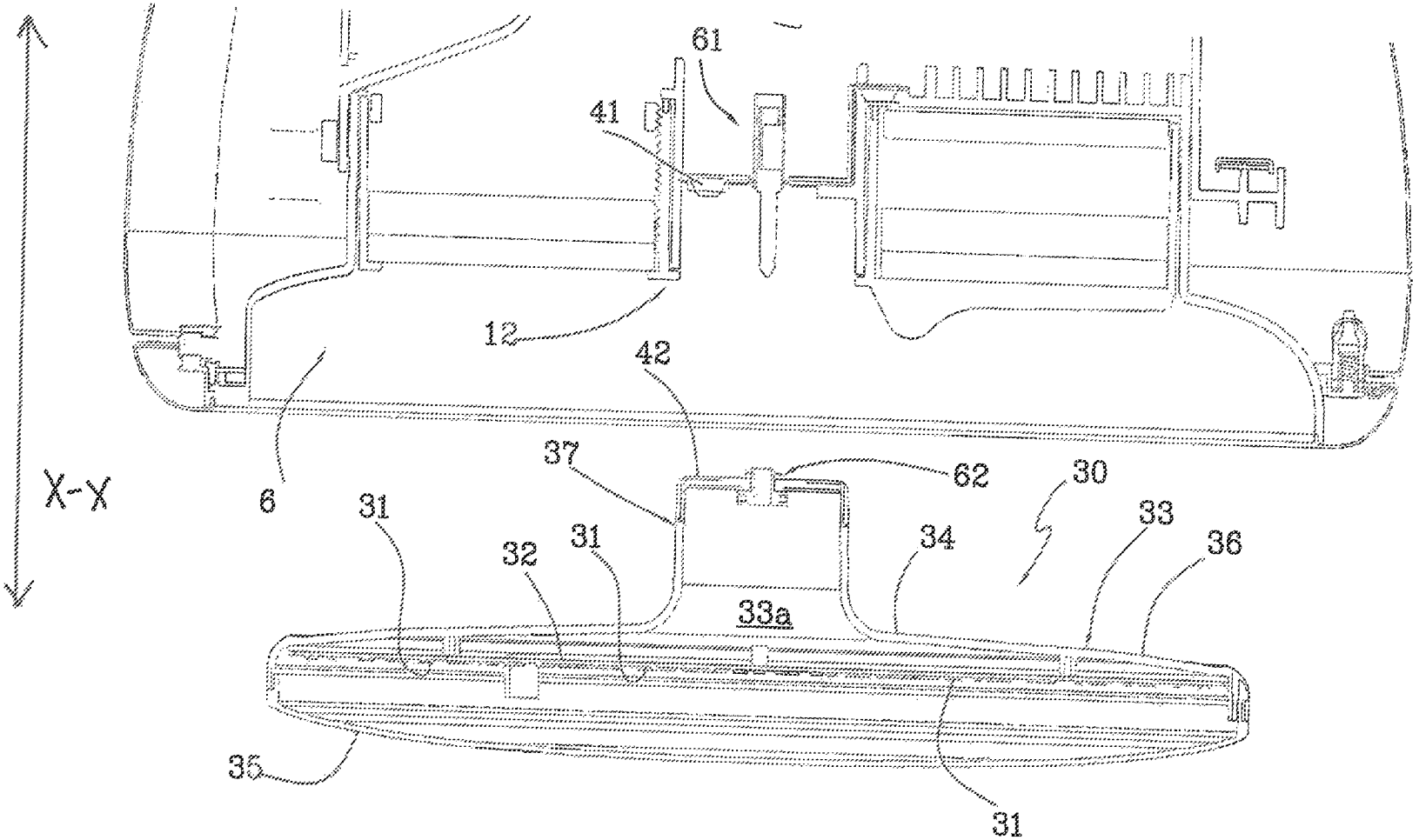
FIG. 5 shows a sectional view of the lighting means removed from the hood frame of the present invention.

The second contact means 62 comprise at least one female terminal, in this example a single female terminal, which is configured to receive and be coupled with a respective male terminal 61 (see FIGS. 4 and 5).

Figure 2:
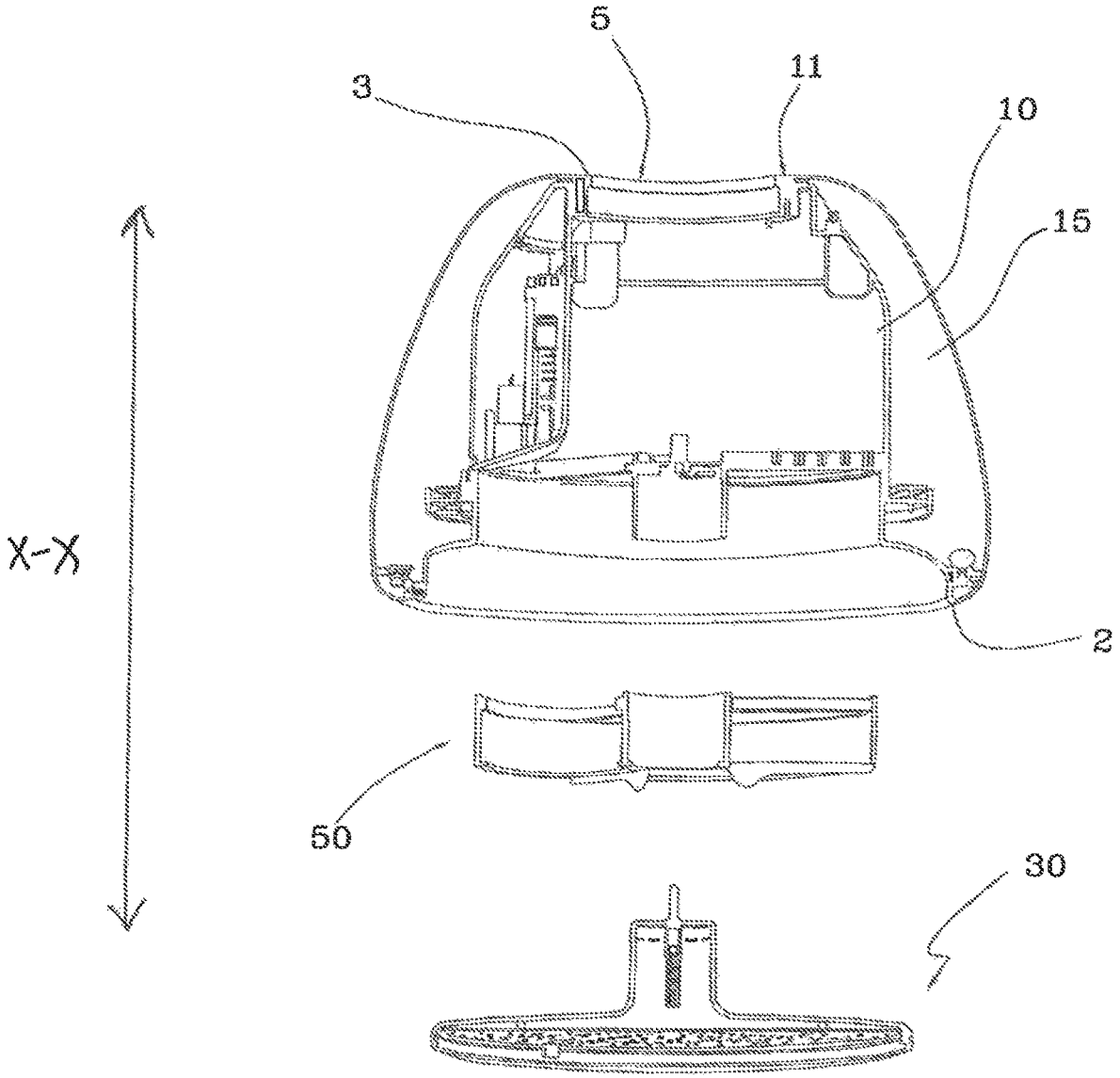
FIG. 2 shows a partially sectional side view of the hood of FIG. 1.
Figure 3:
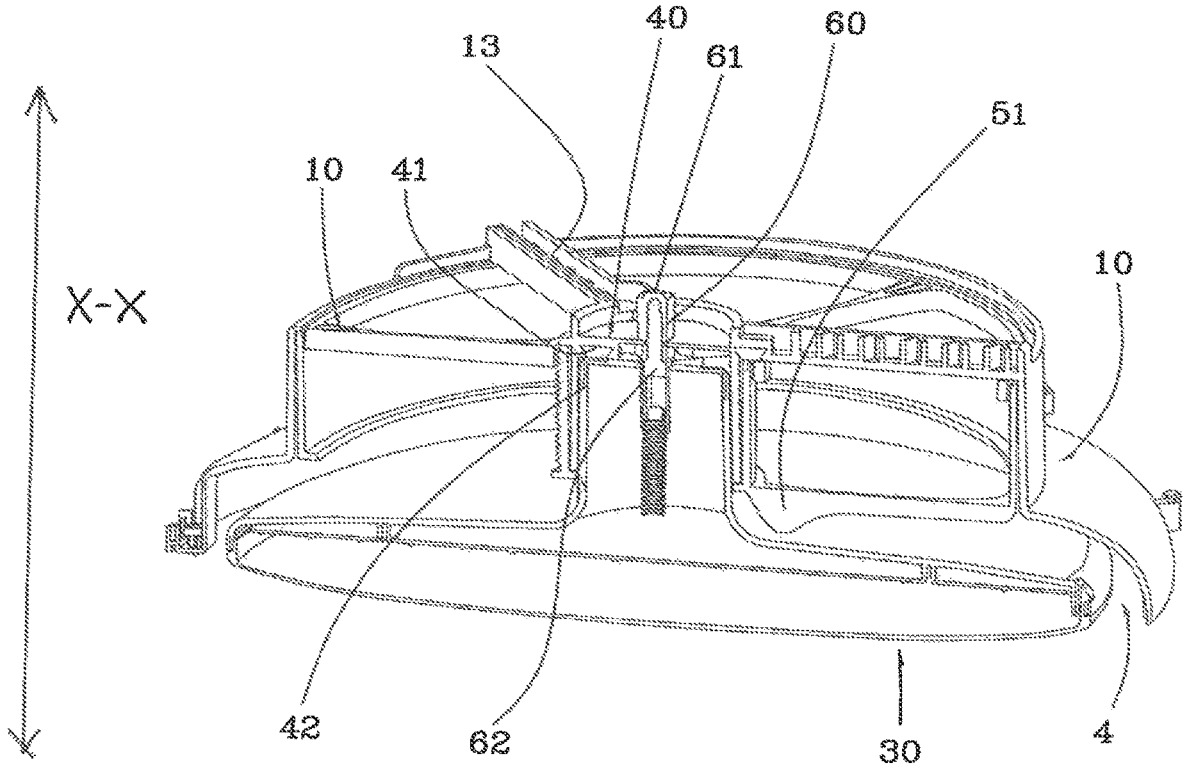
FIG. 3 shows a partially sectional perspective view of the lighting means of the present invention.

Alternatively, the first contact means 61 comprise a female terminal and the second contact means 62 comprise a male terminal (see FIGS. 2 and 3).

In one embodiment, the lighting means 30 are situated at the lower end portion 2 of the frame 10, hence upstream from the filter means 50. In order to accommodate the lighting means 30, the frame 10 has a seat 6 at the lower end portion 2. This seat 6 is designed to receive the lighting means 30 such that, in the first position—corresponding to the operating position—the lighting means 30 form a gap with the perimeter portion of the seat 6.

This gap defines the suction port 4 and allows the user to easily remove the lighting means 30. This is because, due to this gap, the user can access the lateral portion of the lighting means 30 and manually take hold of the lighting means 30 to move them from the first position to the second position.

In one embodiment, the lighting means 30 comprise an enclosure 33 that defines a seat **33*a* containing a plate 32 having a plurality of LEDs 31**.

Nevertheless, in FIGS. 4 and 5 the enclosure 33 that defines the seat **33*a* containing the plate 32 having the plurality of LEDs 31 is itself movable relative to the support frame 10 between the first position (FIG. 4) and the second position (FIG. 5), in which the LEDs 31 are electrically disconnected from the power input 11**.

The LEDs 31 are connected to the second contact means 62.

The enclosure 33 has an upper portion 34 and a lower portion 35.

The second contact means 62 are located in the upper portion 34 and are connected to the LEDs 31. Particularly, the upper portion 34 has an annular part 36 and a central part 37 that projects from the plane of the annular part 36 along the longitudinal direction X-X. The second contact means 62 are located at the upper portion of the central part 37. In this embodiment, the first contact means 61 are arranged in a central part 12 of the support frame 10, which is configured to face the central part 37 of the lighting means 30 in the first position.

Advantageously, the lower portion 35 and the upper portion 34 are removably attached to each other, in this example, by clip-on fastening members, for the LEDs 31 to be accessed and replaced in case of failure.

The lower portion 35 may be transparent or opaque, according to the desired illumination intensity.

In order to allow air to flow from the suction port 4 to the motor fan unit 20, the upper portion 34 of the lighting means 30 is spaced from the filter means 50 to thereby define an annular channel 7 (which is known as perimeter extraction) providing fluid communication between the gap 4 (i.e., the suction port of the hood 1) and the filter means 50. This annular channel 7 also assists the user in taking hold of the lighting means 30 when the latter is in the first position, by allowing him/her to insert the end portions of his/her fingers both in the gap 4 and in the annular channel 7 above it.

The fixing means 40 are also movable between a first position, in which they hold the lighting means 30 attached to the support frame 10 and a second position, in which the lighting means 30 are disengaged from the support frame 10.

In one embodiment, the electric connection means 60 may be configured to also act as fixing means 40. In this case, the first and second positions of the fixing means 40 correspond to the first and second positions of the electric connection means 60 respectively. Therefore, the lighting means 30 are disengaged from the support frame 10 and electrically disconnected from the power input 11 substantially at the same time.

Nevertheless, advantages are derived from using the embodiment in which the electric connection means 60 are distinct from the fixing means 40 and define respective second positions, whereby the lighting means 30 are disengaged from the support frame 10 and are electrically disconnected from the power input 11 at distinct times during removal of the lighting means from the hood 1.

In one embodiment, the fixing means 40 comprise at least one magnetic element 41 and at least one metal element 42, which are located on said support frame 10 and said lighting means 30 respectively, or vice versa, In the first position, the magnetic element 41 holds the metal element 42 to keep the lighting means 30 attached to the support frame 10.

In a second position of the fixing means 40, the metal element 42 disengages from the magnetic element 41. Thus, the metal element 42 disengages from the magnetic element 41 as the lighting means move from the first position to the second position.

In this example, the fixing means 40 comprise three magnetic elements 41 arranged on the support frame 10, at an angular distance of 120° from each other.

The metal element 42 is embedded in the enclosure 33 of the lighting means 30, particularly in its central part 37. Alternatively, the metal element 42 may be stably attached to the enclosure 33.

Due to the use of magnetic elements, as the lighting means 30 move toward the second position, a magnetic gap is formed between the magnetic elements 41 and the metal element 42. The formation of such magnetic gap allows the lighting means 30 to be disengaged from the support frame 10 but still electrically connected to the power input 11 via the electric connection means 60. This electric connection is broken when the lighting means 30 are in the second position.

Those skilled in the art will obviously appreciate that a number of changes and variants may be made to the above described hood, to fulfill particular requirements, without departure from the scope of the invention, as defined in the following claims.

The invention claimed is:

1. A domestic hood, comprising:

a support frame with a power input, the support frame having a central axis;

a motor fan unit located within said support frame;

said support frame extends between a lower end portion and an upper end portion, and at said lower end portion the hood has a suction port in fluid communication with the motor fan unit;

a filter means arranged between the suction port and said motor fan unit and configured to filter gases extracted by the motor fan unit through the suction port;

a lighting means comprising an enclosure that defines a seat containing a plate having a plurality of light-emitting diodes (LEDs), the enclosure having a central projection extending upwardly along an enclosure axis, the enclosure axis being colinear with the central axis;

a fixing means located at least partially on said central projection for removably fixing said lighting means to said support frame; and an electric connection means for electrically connecting said lighting means to said power input, said electrical connection means comprising a first electrical connector placed on the support frame along the central axis and a second electrical connector placed on the central projection of the enclosure, said first electrical connector being configured to mate with said second electrical connector;

wherein said lighting means is situated at the lower end portion of said support frame, upstream from the filter means, wherein said lighting means is movable relative to said support frame between a first position, in which said electric connection means electrically connects said lighting means to said power input, and a second position, in which said lighting means is electrically disconnected from said power input so as to allow access to an interior of said support frame for replacing said filter means, and wherein said electric connection means is configured to electrically disconnect said lighting means from said power input without any intermediate step, once said lighting means has moved from said first position to said second position.

2. The domestic hood as claimed in claim 1, wherein:

as said second electrical connector moves from the first position to the second position, said second electrical connector moves with said lighting means, in said first position, said first electrical connector contacts said second electrical connector to electrically connect said lighting means to said power input, and in said second position, said second electrical connector is electrically disconnected from said first electrical connector to electrically insulate said lighting means.

3. The domestic hood as claimed in claim 2, wherein:

said first electrical connector comprises at least one male terminal, and said second electrical connector comprises at least one female terminal, said at least one female terminal being configured to receive and be coupled with a respective male terminal of the first electrical connector.

4. The domestic hood as claimed in claim 2, wherein:

said first electrical connector comprises at least one female terminal, and said second electrical connector comprises at least one male terminal, said at least one male terminal being configured to be coupled with a respective female terminal of the first electrical connector.

5. The domestic hood as claimed in claim 1, wherein said fixing means comprises at least one magnetic element and at least one metal element, which are located on said support frame and said lighting means respectively, or vice versa.

6. The domestic hood as claimed in claim 5, wherein:

in said first position, said at least one magnetic element holds said at least one metal element to keep said lighting means attached to said support frame, and in said second position, said at least one metal element is released from said at least one magnetic element.

7. The domestic hood as claimed in claim 5, wherein said at least one metal element disengages from said at least one magnetic element as said lighting means moves from said first position to said second position.

8. The domestic hood as claimed in claim 6, wherein said at least one metal element disengages from said at least one magnetic element as said lighting means moves from said first position to said second position.

9. A domestic hood, comprising:

a support frame having a power input, the support frame having a central axis;

a motor fan unit within the support frame;

a filter means configured to filter gases extracted by the motor fan unit;

a lighting means comprising an enclosure having a central projection extending upwardly along an enclosure axis, the enclosure axis being colinear with the central axis;

a fixing means located at least partially on said central projection for removably fixing the lighting means to the support frame; and an electric connection means for electrically connecting the lighting means to the power input, said electrical connection means comprising a first electrical connector placed on the support frame along the central axis and a second electrical connector placed on the central projection of the enclosure, said first electrical connector being configured to mate with said second electrical connector;

wherein the support frame extends between a lower end portion of the support frame and an upper end portion of the support frame, wherein the domestic hood comprises a suction port at the lower end portion of the support frame, in fluid communication with the motor fan unit, wherein the motor fan unit is configured to extract the gases through the suction port, then through the filter means, and then through the motor fan unit, wherein the lighting means is movable relative to the support frame between a first position, in which the first electrical connector is mated to the second electrical connector to connect the lighting means to the power input, and a second position, in which the first electrical connector is electrically disconnected from the second electrical connector so as to allow access to an interior of the support frame for replacing the filter means, and wherein when the lighting means moves from the first position to the second position, the electrical connection means electrically disconnects the lighting means from the power input without any intermediate step.

10. The domestic hood of claim 9, wherein the fixing means comprises at least one magnetic element on the support frame and at least one metal element on the lighting means, or at least one magnetic element on the lighting means and at least one metal element on the support frame.

11. The domestic hood of claim 10, wherein in the first position, the at least one magnetic element holds the at least one metal element to keep the lighting means attached to the support frame, and wherein in the second position, the at east one metal element is released from the at least one magnetic element.

12. The domestic hood of claim 10, wherein the at least one metal element disengages from the at least one magnetic element as the lighting means moves from the first position to the second position.

13. The domestic hood of claim 9, wherein as the second electrical connector moves from the first position to the second position; the second electrical connector moves with the lighting means.

14. The domestic hood of claim 13, wherein in the first position, the first electrical connector contacts the second electrical connector to electrically connect the lighting means to the power input, and wherein in the second position, the second electrical connector is electrically disconnected from the first electrical connector to electrically insulate the lighting means.

15. A domestic hood, comprising:

a support frame having a power input, the support frame having a central axis;

a motor fan unit within the support frame;

a filter means configured to filter gases extracted by the motor fan unit;

a lighting means comprising an enclosure having a central projection extending upwardly along an enclosure axis, the enclosure axis being colinear with the central axis;

a fixing means located at least partially on said central projection for removably fixing the lighting means to the support frame; and an electric connection means comprising a first electrical connector placed on the support frame along the central axis and a second electrical connector placed on the central projection of the enclosure, said first electrical connector being configured to mate with said second electrical connector;

wherein the support frame extends between a lower end portion of the support frame and an upper end portion of the support frame, wherein the domestic hood comprises a suction port between the lighting means and the lower end portion of the support frame, in fluid communication with the motor fan unit, wherein the motor fan unit is configured to extract the gases through the suction port, then through the filter means, and then through the motor fan unit, wherein the lighting means is movable relative to the support frame between a first position, in which the first electrical connector is mated to the second electrical connector to connect the lighting means to the power input, and a second position, in which the first electrical connector is electrically disconnected from the second electrical connector so as to allow access to an interior of the support frame for replacing the filter means, wherein in the first position, the lighting means is at the lower end portion of the support frame, upstream from the filter means, and wherein when the lighting means moves from the first position to the second position, the electrical connection means electrically disconnects the lighting means from the power input without any intermediate step.

16. The domestic hood of claim 15, wherein the fixing means comprises at least one magnetic element on the support frame and at least one metal element on the lighting means, or at least one magnetic element on the lighting means and at least one metal element on the support frame.

17. The domestic hood of claim 16, wherein in the first position, the at least one magnetic element holds the at least one metal element to keep the lighting means attached to the support frame, and wherein in the second position, the at least one metal element is released from the at least one magnetic element.

18. The domestic hood of claim 16, wherein the at least one metal element disengages from the at least one magnetic element as the lighting means moves from the first position to the second position.

19. The domestic hood of claim 15, wherein as the second electrical connector moves from the first position to the second position, the second electrical connector moves with the lighting means.

20. The domestic hood of claim 19, wherein in the first position, the first electrical connector contacts the second electrical connector to electrically connect the lighting means to the power input, and wherein in the second position, the second electrical connector is electrically disconnected from the first electrical connector o electrically insulate the lighting means.

* * * * *